US007518303B2

(12) United States Patent
Lee et al.

(10) Patent No.: US 7,518,303 B2
(45) Date of Patent: Apr. 14, 2009

(54) ELECTRON EMISSION DEVICE WITH PLURALITY OF LEAD LINES CROSSING ADHESIVE FILM

(75) Inventors: Byong-Gon Lee, Suwon-si (KR); Sang-Ho Jeon, Suwon-si (KR)

(73) Assignee: Samsung SDI Co., Ltd., Suwon-si (KR)

( * ) Notice: Subject to any disclaimer, the term of this patent is extended or adjusted under 35 U.S.C. 154(b) by 420 days.

(21) Appl. No.: 11/291,799

(22) Filed: Nov. 30, 2005

(65) Prior Publication Data

US 2006/0244360 A1 Nov. 2, 2006

(30) Foreign Application Priority Data

Nov. 30, 2004 (KR) ..... 10-2004-0099559

(51) Int. Cl.
*H01J 1/62* (2006.01)
*H01J 63/04* (2006.01)

(52) U.S. Cl. ..... 313/495; 313/496; 313/346 R

(58) Field of Classification Search ..... 313/495–497, 313/309, 310, 336, 351, 346 R
See application file for complete search history.

(56) References Cited

U.S. PATENT DOCUMENTS

2002/0030435 A1* 3/2002 Sato et al. ..... 313/495
2004/0164665 A1* 8/2004 Sasaki et al. ..... 313/495
2004/0217688 A1* 11/2004 Hirasawa et al. ..... 313/497
2005/0046332 A1* 3/2005 Tajima et al. ..... 313/495
2005/0082963 A1* 4/2005 Miyazaki et al. ..... 313/493
2005/0110389 A1* 5/2005 Kijima et al. ..... 313/495
2005/0275337 A1* 12/2005 Kijima et al. ..... 313/495
2006/0033419 A1* 2/2006 Hirasawa et al. ..... 313/495
2006/0038481 A1* 2/2006 Kijima et al. ..... 313/495
2006/0043877 A1* 3/2006 Inoue et al. ..... 313/496

* cited by examiner

*Primary Examiner*—Joseph L Williams
*Assistant Examiner*—Kevin Quarterman
(74) *Attorney, Agent, or Firm*—Christie, Parker & Hale, LLP

(57) ABSTRACT

An electron emission device includes first and second substrates facing each other, an electron emission structure formed on the first substrate, and a light emission structure formed on the second substrate. The light emission structure has phosphor layers and an anode electrode formed on a surface of the phosphor layers. An adhesive film is formed at the peripheries of the first and the second substrates to attach the first and the second substrates to each other. At least one lead portion crosses the adhesive film on the second substrate, and is connected to the anode electrode. The lead portion is partitioned into a plurality of lead lines at the crossed region thereof with the adhesive film, and the plurality of lead lines are spaced from each other.

20 Claims, 6 Drawing Sheets

ELECTRON EMISSION DEVICE WITH PLURALITY OF LEAD LINES CROSSING ADHESIVE FILM

CROSS-REFERENCE TO RELATED APPLICATION

This application claims priority to and the benefit of Korean Patent Application No. 10-2004-0099559 filed in the Korean Intellectual Property Office on Nov. 30, 2004, the entire content of which is incorporated herein by reference.

BACKGROUND OF THE INVENTION

Field of the Invention

The present invention relates to an electron emission device, and in particular, to an electron emission device which is connected to an external electric power source through lead portions and pad electrodes to receive a high voltage required for accelerating the electron beams.

Description of Related Art

Generally, electron emission devices are classified into a first type where a hot cathode is used as an electron emission source, and a second type where a cold cathode is used as the electron emission source.

Among the second type electron emission devices there is known a field emitter array (FEA) type, a surface conduction emitter (SCE) type, a metal-insulator-metal (MIM) type, a metal-insulator-semiconductor (MIS) type, and a ballistic electron surface emitting (BSE) type.

The MIM-type and the MIS-type electron emission devices have a metal/insulator/metal (MIM) electron emission structure and a metal/insulator/semiconductor (MIS) electron emission structure, respectively. When voltages are applied to the metallic layers or to the metallic and the semiconductor layers, electrons are transferred and accelerated from the metallic layer or the semiconductor layer having a high electric potential to the metallic layer having a low electric potential, thereby providing the electron emission.

The SCE-type electron emission device includes first and second electrodes formed on a substrate while facing each other, and a conductive thin film disposed between the first and the second electrodes. Micro-cracks are made at the conductive thin film to form electron emission regions. When voltages are applied to the electrodes while making an electric current flow to the surface of the conductive thin film, electrons are emitted from the electron emission regions.

The FEA-typed electron emission device is based on the principle that when a material having a low work function or a high aspect ratio is used as an electron emission source, electrons are easily emitted from the electron emission source when an electric field is applied thereto under a vacuum atmosphere. A front sharp-pointed tip structure based on molybdenum (Mo) or silicon (Si), or a carbonaceous material, such as carbon nanotube, graphite and diamond-like carbon, has been developed to be used as the electron emission source.

With the electron emission device using the cold cathode, first and second substrates form a vacuum structure, and electron emission regions and driving electrodes are formed at the first substrate. Phosphor layers and an anode electrode for accelerating the electrons emitted from the first substrate toward the second substrate are formed at the second substrate to provide the light emission or the image displaying.

In order to receive the high voltage required for accelerating the electron beams, the anode electrode is connected to an external electric power source via lead wires formed throughout the inside and the outside of the vacuum structure on the second substrate while receiving a direct current potential, and pad electrodes are formed external to the vacuum structure. When a large amount of current flow is transmitted to the anode electrode, a structure is used where a plurality of lead wires are arranged or the width of the lead wires is enlarged, in view of the resistance of the lead wires.

The first and the second substrates forming the vacuum structure are sealed to each other through a seal frit to prevent external air from being introduced into the vacuum structure. However, while the seal frit exerts excellent adhesion with respect to oxide film, glass, ceramic, or indium tin oxide (ITO), it does not with respect to chromium (Cr) used for the lead wires of the anode electrode. As a result, the vacuum state of the vacuum structure may be compromised.

This vacuum compromise phenomenon results because of the shortage of diffusion media for attaching the seal frit to chromium. In order to prevent such a phenomenon, a method of forming an oxide film or a black oxide film has been proposed. However, since such a film formation process is conducted at a high temperature exceeding the glass transition temperature (about 800-1100° C.), it is not preferable to conduct a film formation process with respect to the lead wires formed on the second substrate.

SUMMARY OF THE INVENTION

In accordance with the present invention an electron emission device is provided which attaches lead portions to the second substrate while exerting excellent hermetic seal effect without performing a separate process.

The electron emission device includes first and second substrates facing each other, an electron emission structure formed on the first substrate, and a light emission structure formed on the second substrate. The light emission structure has phosphor layers, and an anode electrode formed on a surface of the phosphor layers. An adhesive film is formed at the peripheries of the first and the second substrates to attach the first and the second substrates to each other. At least one lead portion crosses the adhesive film at a cross region on the second substrate, and is connected to the anode electrode. The lead portion is partitioned into a plurality of lead lines at the crossed region thereof with the adhesive film, and the plurality of lead lines are spaced from each other.

The respective lead lines may have a maximum width of about 500 μm, and the lead lines of each lead portion may be spaced from each other at a minimum distance of about 50 μm.

Opening portions are formed at the lead portion where the lead portion and the adhesive film cross each other, or each of the at least one lead portion is partitioned into a plurality of lead lines over the entire region of each of the at least one lead portion. With the formation of the opening portion at the lead portion, when measured along the length of the lead portion, the width of the opening portion is larger than the width of the adhesive film.

The lead portions may be formed with a metallic film based on chromium (Cr) having a thickness of less than 5 μm.

DETAILED DESCRIPTION

Figure 1:
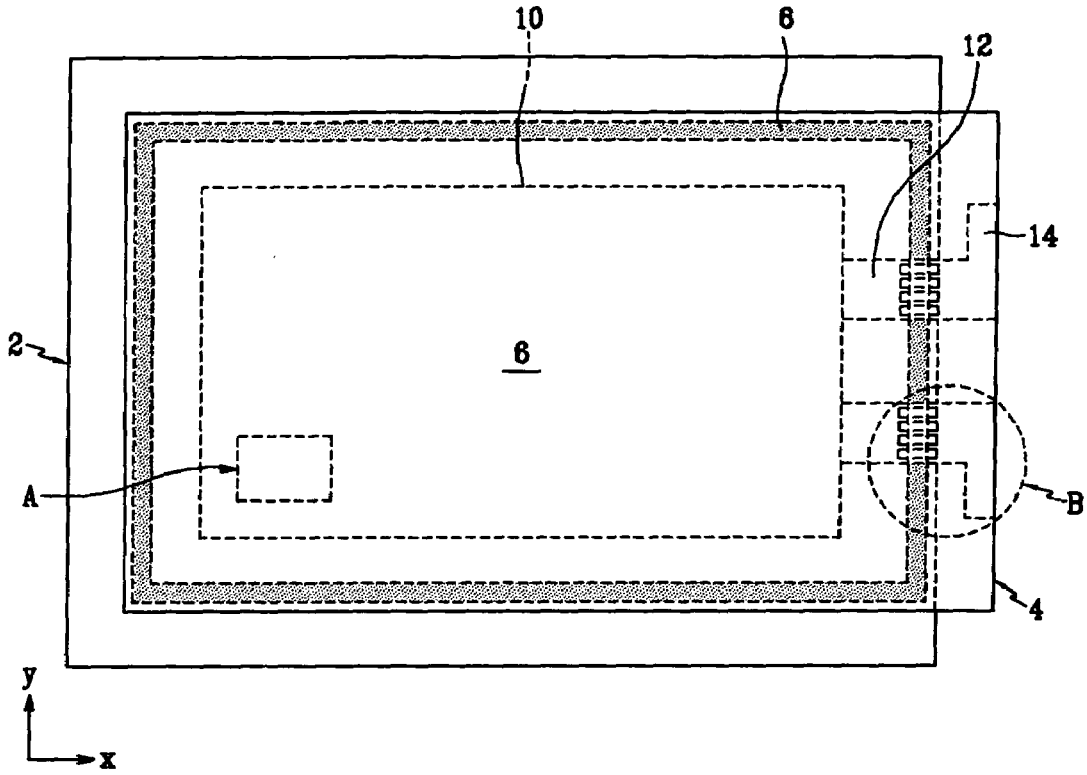
FIG. 1 is a plan view of an electron emission device according to a first embodiment of the present invention.
Figure 5:
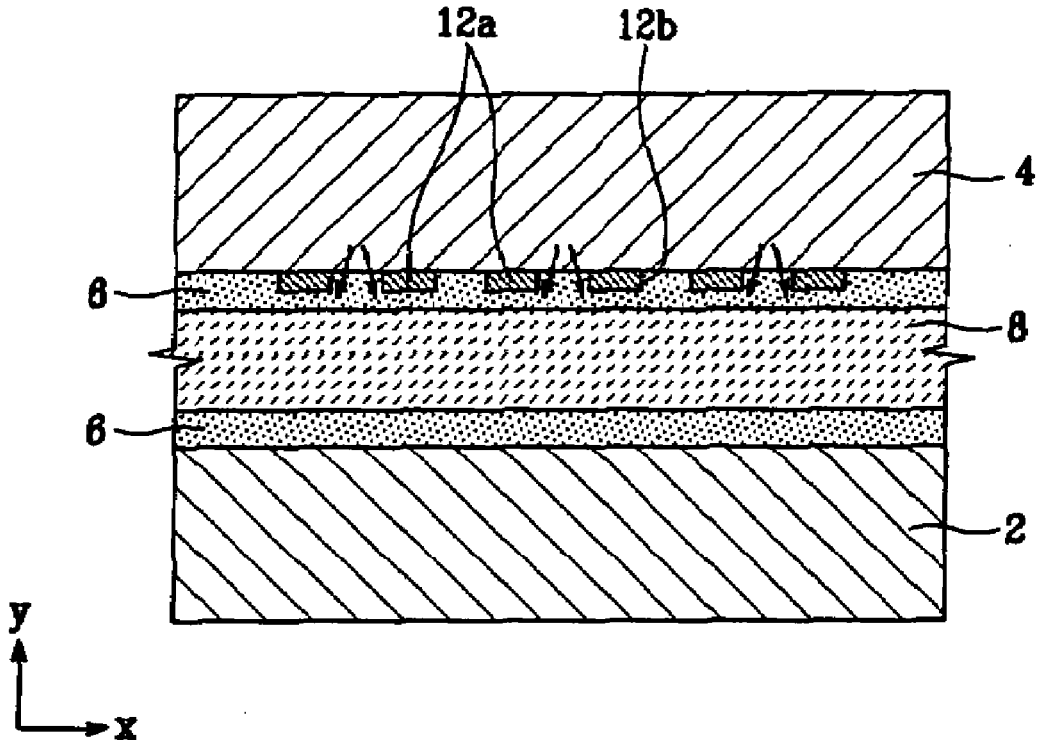
FIG. 5 is a partial sectional view of the electron emission device taken along the V-V line of FIG. 4.

Referring to FIG. 1, the electron emission device includes first and second substrates 2, 4 proceeding substantially parallel to each other with an inner space therebetween. The peripheries of the first and the second substrates 2, 4 are sealed to each other by using an adhesive film 6 and a side glass 8 (as shown in FIG. 5). The inner space between the first and the second substrates 2, 4 is exhausted under the pressure of $10^{-6}$-$10^{-7}$ torr to thereby form a vacuum structure.

In this embodiment, a side glass 8 is placed between the first and the second substrates 2, 4, and an adhesive film 6 is formed on the top and the bottom of the side glass 8, thereby attaching the first and the second substrates 2 and 4 to each other. The way of attaching the substrates to each other is not limited thereto, but various ways may be used to achieve that purpose which are encompassed by the scope of the present invention.

An electron emission structure including electron emission regions (not shown) and driving electrodes (not shown) is formed on the first substrate 2, and a light emission structure including phosphor layers (not shown) and an anode electrode 10 for accelerating the electrons emitted from the first substrate 2 toward the second substrate 4 are formed on the surface of the second substrate 4 facing the first substrate 2. The electron emission structure and the light emission structure will be explained later with reference to FIGS. 2 and 3.

The anode electrode 10 is placed within the vacuum structure surrounded by the adhesive film 6. A pair of lead portions 12 connected to the anode electrode 10 are drawn to the one-sided periphery of the second substrate 4, and are formed throughout the inside and the outside of the vacuum structure. Pad electrodes 14 are formed on the second substrate 4 external to the vacuum structure such that they are connected to the respective lead portions 12.

The pad electrodes 14 are connected to an external electrical power source (not shown) in one to one correspondence with the lead portions 12, and apply the high voltage required for accelerating the electron beams to the anode electrode 10 via the lead portions 12. The lead portions 12 will be explained later with reference to FIGS. 4 and 5.

First, an electron emission structure and a light emission structure will be explained more with reference to FIGS. 2 and 3 in more detail.

Figure 2:
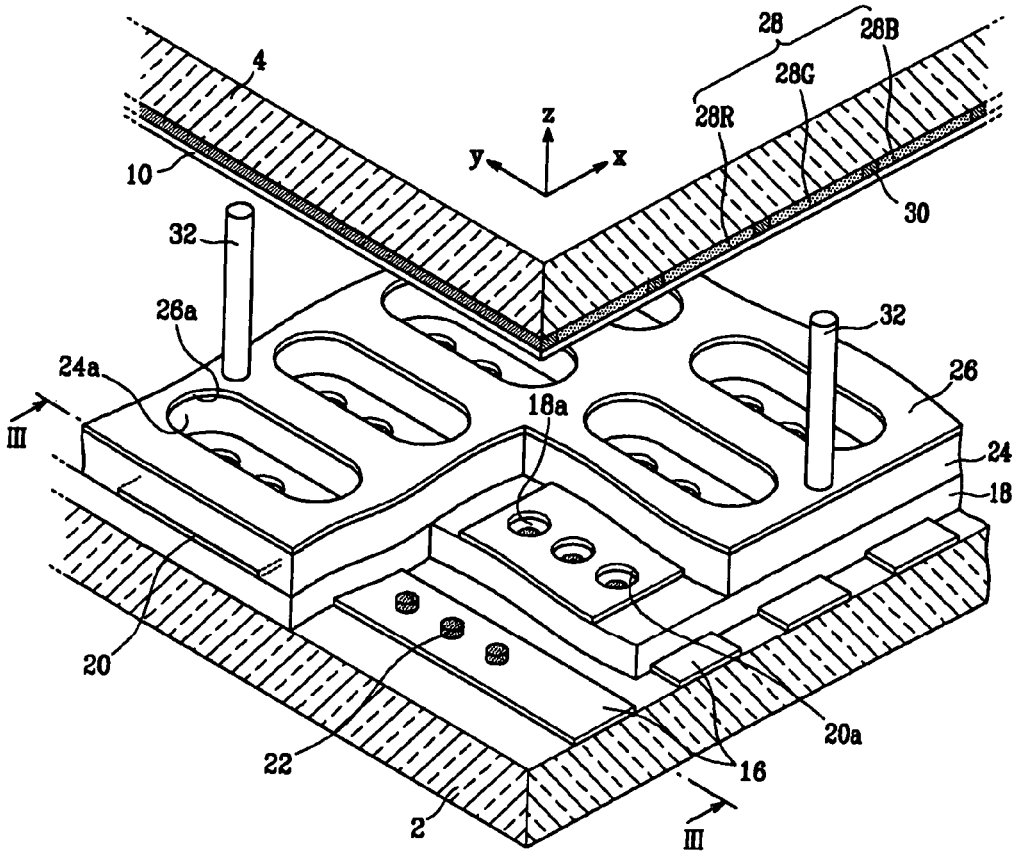
FIG. 2 is a partial exploded perspective view of the electron emission device, amplifying and illustrating the A portion of FIG. 1.
Figure 3:
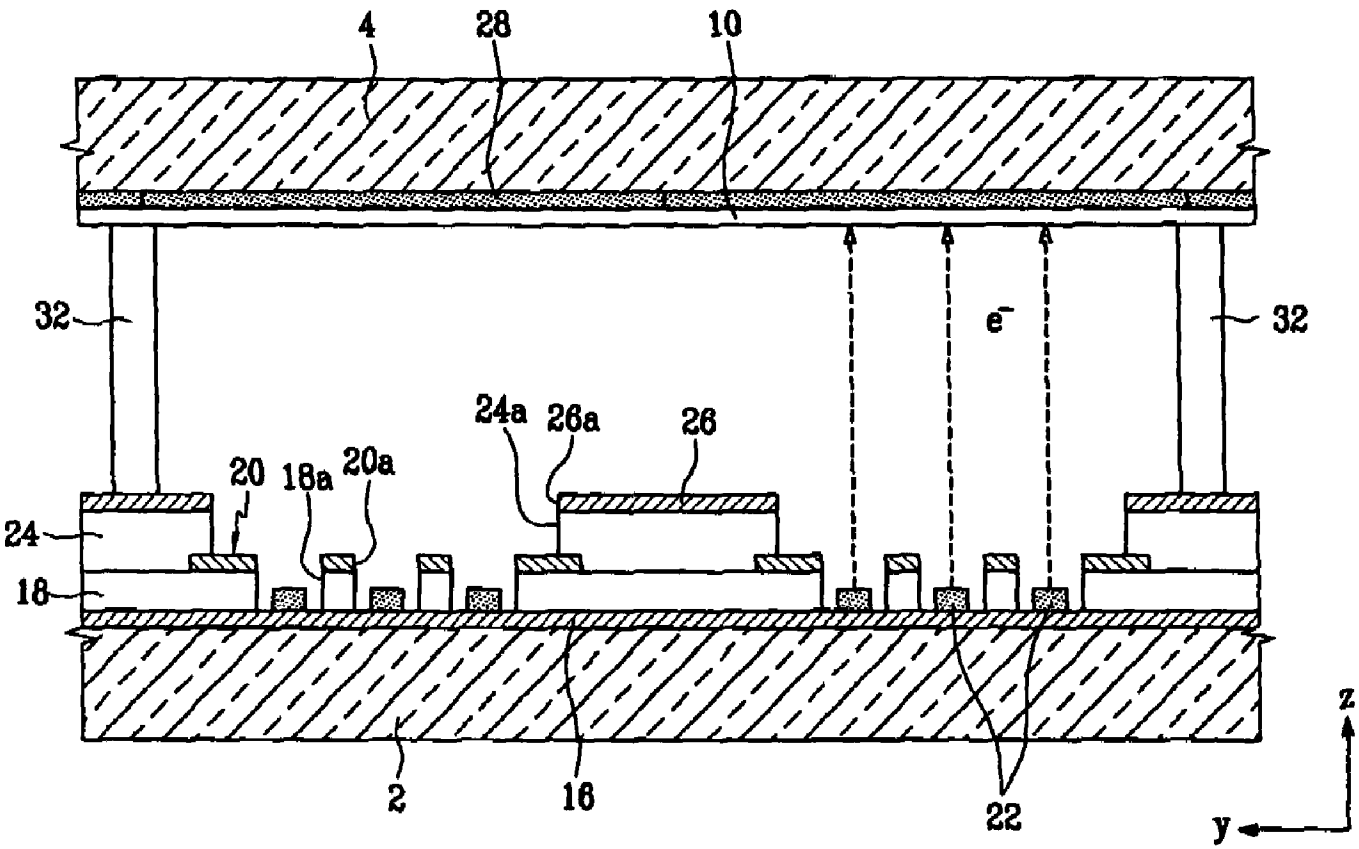
FIG. 3 is a partial sectional view of the electron emission device taken along the III-III line of FIG. 2.

FIG. 2 is a partial exploded perspective view of the electron emission device, amplifying and illustrating the A portion of FIG. 1, and FIG. 3 is a partial sectional view of the electron emission device taken along the III-III line of FIG. 2.

As shown in FIGS. 2 and 3, cathode electrodes 16 are stripe-patterned on the first substrate 2 in a direction (in the direction of the y axis of the drawing), and a first insulating layer 18 is formed on the entire surface of the first substrate 2 while covering the cathode electrodes 16. Gate electrodes 20 are stripe-patterned on the first insulating layer 18 in a direction proceeding substantially perpendicular to the cathode electrodes 16 (in the direction of the x axis of the drawing).

In this embodiment, when the crossed regions of the cathode and the gate electrodes 16 and 20 are defined as pixel regions, one or more electron emission regions 22 are formed on the cathode electrodes 16 at the respective pixel regions. Opening portions 18*a* and 20*a* are formed at the first insulating layer 18 and the gate electrodes 20 while exposing the respective electron emission regions 22.

The electron emission regions 22 are formed with material emitting electrons when an electric field is applied thereto under a vacuum atmosphere, such as a carbonaceous material or a nanometer-sized material. The electron emission regions 22 in exemplary embodiments may be formed with carbon nanotube, graphite, graphite nanofiber, diamond, diamond-like carbon, $C_{60}$, silicon nanowire, or a combination thereof. The electron emission regions 22 may be formed through screen printing, direct growth, chemical vapor deposition, or sputtering.

It is illustrated in the drawings that the electron emission regions 22 are circular-shaped, and linearly arranged along the length of the cathode electrodes 16 (in the y axis direction of the drawing) at the respective pixel regions. The plane shape, the number per pixel and the arrangement of the electron emission regions 22 are not limited thereto, but may be altered in various manners.

Furthermore, the gate electrodes 20 are placed over the cathode electrodes 16 with the first insulating layer 18 interposed therebetween. Alternatively, the cathode electrodes may be placed over the gate electrodes. In this case, the electron emission regions contact the lateral sides of the cathode electrodes on the insulating layer.

A second insulating layer 24 and a focusing electrode may be formed on the gate electrodes 20. Opening portions 24*a* and 26*a* are formed at the second insulating layer 24 and the focusing electrode 26 to allow for the passage of electron beams. For instance, the opening portions 24*a* and 26*a* are provided at the respective pixels one by one such that the focusing electrode 26 collectively focuses the electrons emitted at each pixel. The greater the height difference between the focusing electrode 26 and the electron emission regions 22, the better the focusing effect of the focusing electrode 26. In an exemplary embodiment, the thickness of the second insulating layer 24 is larger than that of the first insulating layer 18.

The focusing electrode 26 may be formed on the entire surface of the first substrate 2, or patterned with a plurality of separate portions, which are not illustrated in the drawings. The focusing electrode 26 may be formed with a conductive film coated on the second insulating layer 24, or a metallic plate with opening portions 26*a*.

Red, green and blue phosphor layers 28R, 28G and 28B are formed on a surface of the second substrate 4 facing the first substrate 2 while being spaced from each other. Black layers 30 are disposed between the neighboring phosphor layers 28 to enhance the screen contrast. It is illustrated in the drawings that the phosphor layers 28 and the black layers 30 are stripe-patterned, but the phosphor layers are placed at the pixel regions defined on the first substrate in one to one correspondence therewith. In this case, the black layers are formed at the entire non-light emission area except for the phosphor layers.

An anode electrode 10 is formed on the phosphor layers 28 and the black layers 30 with a metallic material. The anode electrode 10 receives from the outside a high voltage required for accelerating the electron beams, and reflects the visible rays radiated from the phosphor layers 28 to the first substrate 2 toward the second substrate 4 to heighten the screen luminance.

In this embodiment, the anode electrode 10 is formed with a single electrode covering the phosphor layers 28, but may be patterned with a plurality of separate portions.

Spacers 32 are arranged between the first and the second substrates 2 and 4 to space them from each other. The spacers 32 are placed at the non-light emission areas where the black layers 30 are located.

The electron emission structure is not limited to the above, but may be altered in various manners such that separate electrodes are provided or the focusing electrode is omitted. Furthermore, in addition to the FEA-typed, the electrode emission structure may be applied for use in constructing the SCE-type, the MIM-type and the BSE-type taking a cold cathode as an electron emission source.

The lead portions 12 and the pad electrodes 14 will be now explained with reference to FIGS. 4 and 5.

Figure 4:
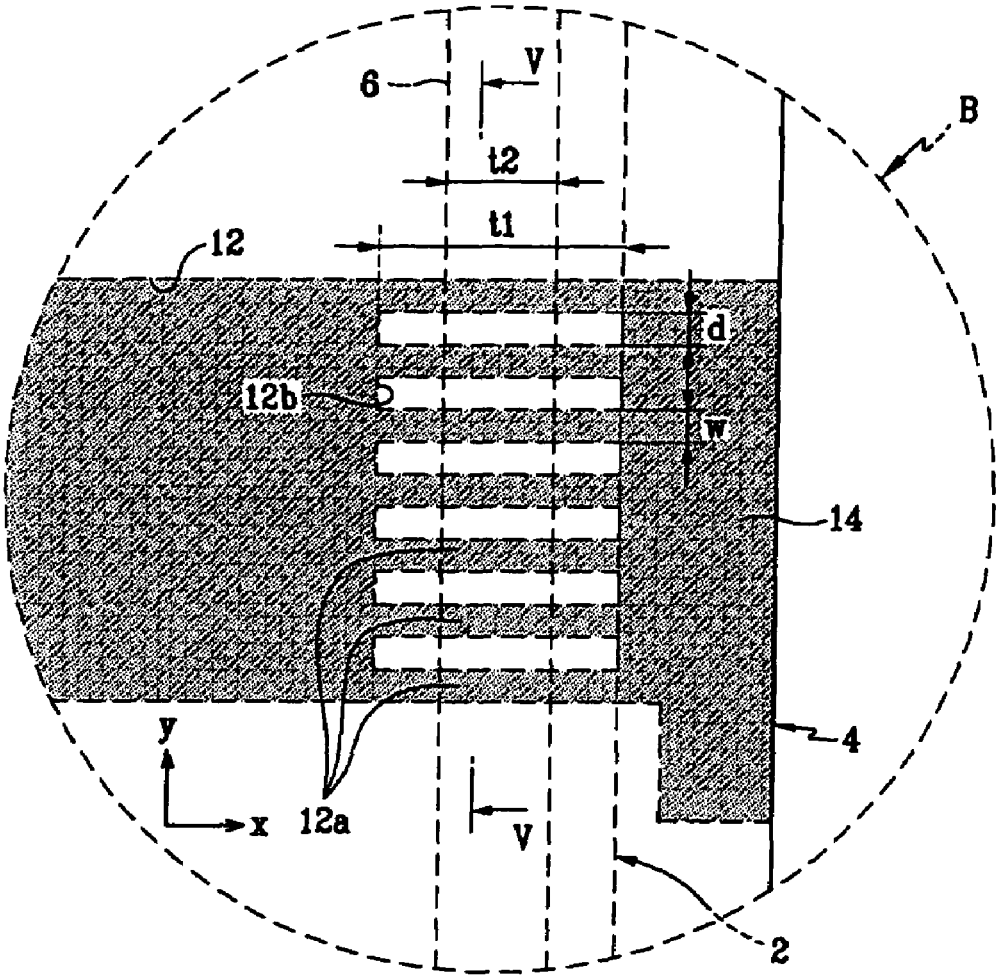
FIG. 4 is a partial plan view of the electron emission device, amplifying and illustrating the B portion of FIG. 1.

FIG. 4 is a partial plan view of the electron emission device where the B portion of FIG. 1 is amplified and illustrated, and FIG. 5 is a partial sectional view of the electron emission device taken along the V-V line of FIG. 4.

In this embodiment, opening portions 12*b* are formed at the lead portion 12 at the crossed region thereof with the adhesive film 6, and the lead portion 12 is partitioned into a plurality of lead lines 12*a* at the crossed region thereof with the adhesive film 6 due to the opening portions 12*b*. The adhesive film 6 directly contacts the second substrate 4 through the opening portions 12*b*.

When measured along the length of the lead portion 12 (in the direction of the x axis of the drawing), the width t1 of the opening portion 12*b* is established to be larger than the width t2 of the adhesive film 6. This is to contact the entire surface of the adhesive film 6 with the second substrate 4 along the length of the lead portion 12.

The lead lines 12*a* of the respective lead portions 12 are spaced from each other with a minimum distance d of 50 μm, and the width w of each lead line 12*a* in an exemplary embodiment is established to be a maximum of 500 μm. This is to sufficiently enlarge the area of the adhesive film 6 contacting the second substrate 4 through the opening portions 12*b*.

The lead portions 12 are formed with a metallic material having excellent electrical conductivity, such as chromium Cr. The lead portions 12 have a thickness of less than 5 μm. The lead portions 12 may be formed with the same material as the black layers 30 (as shown in FIGS. 2 and 3), and patterned simultaneously with the black layers 30, thereby simplifying the processing steps.

In this embodiment, the adhesive film 6 is formed with a seal frit having a low melting point glass composition based on $PbO—B_2O_3$, $PbO—B_2O_3—SiO_2$, or $PbO—B_2O_3—SiO_2—ZnO$. As shown in FIG. 5, the adhesive film 6 contacts the second glass substrate 4 through the opening portions 12*b* of the lead portion 12. During the high temperature firing process, the adhesive film 6 interacts with the second substrate 4 (see the arrows of the drawing) to thereby exert excellent adhesion effect.

With the excellent adhesion between the second substrate 4 and the adhesive film 6, the metallic lead portions 12 are hermetically attached to the surface of the second substrate 4 in a vacuum tight manner. Accordingly, with the present embodiment, the possibility of vacuum breakage due to the deterioration in the adhesion between the metallic lead portions and the adhesive film can be reduced. Furthermore, a separate process of forming an oxide film or a black oxide film on the lead portions 12 is not needed, thereby simplifying the processing steps.

Referring back to FIG. 4, the width w of the lead portions 12 is enlarged due to the partitioned lead lines 12*a* so that the internal resistance generated when a high voltage is applied to the anode electrode 10 can be minimized.

An electron emission device according to a second embodiment of the present invention will now be explained in more detail. Other structural components of the electron emission device according to the second embodiment of the present invention are the same as those related to the first embodiment except for the shape of the lead lines. Detailed explanation and illustration for the same structural components of the electron emission device as those related to the first embodiment will be omitted, and like reference numerals will be used to refer to those components.

Figure 6:
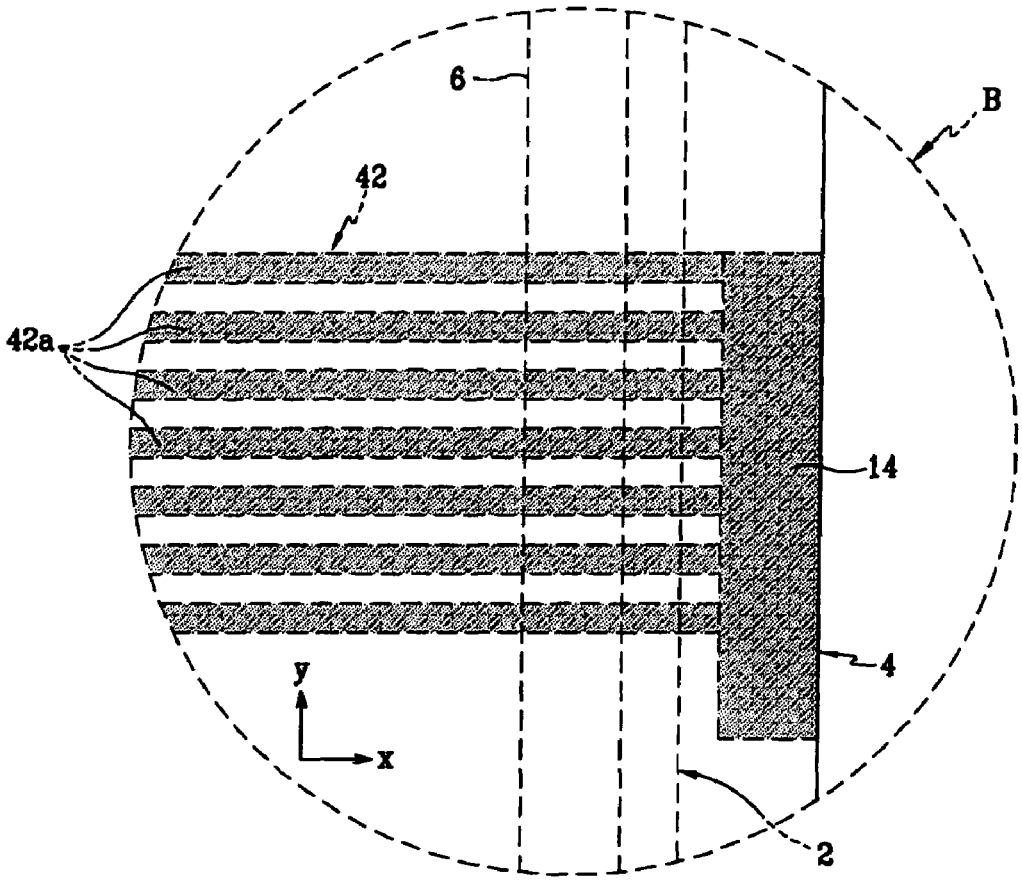
FIG. 6 is a partial plan view of an electron emission device according to a second embodiment of the present invention.

FIG. 6 is a plan view of the electron emission device according to the second embodiment of the present invention. The lead lines 42*a* of the respective lead portions 42 are wholly separated from each other, and the separated lead lines 42*a* are spaced from each other. The second substrate 4 directly contacts the adhesive film 6 through the separated lead lines 42*a*.

The lead portions 42 are formed with a metallic material having excellent electrical conductivity, such as chromium (Cr). The lead portions 42 may have a thickness of less than 5 μm.

In an exemplary embodiment, the respective lead lines 42*a* have a maximum width of 500 μm, and are spaced from each other with a minimum distance of 50 μm. This is to sufficiently enlarge the contact area between the second substrate 4 and the adhesive film 6.

In this embodiment, the lead portions 42 may be hermetically attached to the surface of the second substrate 4 without performing a separate process of forming an oxide film or a black oxide film on the lead portions 42.

Although exemplary embodiments of the present invention have been described in detail hereinabove, it should be understood that many variations and/or modifications of the basic inventive concept herein taught which may appear to those skilled in the art will still fall within the spirit and scope of the present invention, as defined in the appended claims.

What is claimed is:

1. An electron emission device comprising:

a first substrate and a second substrate facing each other;

an electron emission structure on the first substrate;

a light emission structure on the second substrate, the light emission structure including phosphor layers and an anode electrode on a surface of the phosphor layers;

an adhesive film at peripheries of the first substrate and the second substrate to attach the first substrate and the second substrate to each other; and at least one lead portion crossing the adhesive film on the second substrate at a cross region and being connected to the anode electrode;

wherein the at least one lead portion is partitioned into a plurality of lead lines at the cross region, and the plurality of lead lines are spaced from each other.

2. The electron emission device of claim 1, wherein the plurality of lead lines comprises individual lead lines, the individual lead lines having a maximum width of about 500μm.

3. The electron emission device of claim 1, wherein the plurality of lead lines of the at least one lead portion comprises individual lead lines, the individual lead lines being spaced from each other at a minimum distance of about 50μm.

4. The electron emission device of claim 1, wherein the at least one lead portion includes an opening portion at the cross region.

5. The electron emission device of claim 4, wherein the width of the opening portion is larger than the width of the adhesive film when measured along the length of the at least one lead portion.

6. The electron emission device of claim 1, wherein each of the at least one lead portion is partitioned into a plurality of lead lines over the entire region of each of the at least one lead portion.

7. The electron emission device of claim 1, wherein the at least one lead portion is a metallic film having a thickness of less than about 5μm.

8. The electron emission device of claim 7, wherein the at least one lead portion is chromium Cr.

9. The electron emission device of claim 1, wherein at least one pad electrode is on the second substrate external to the adhesive film in a one to one correspondence with the at least one lead portion.

10. The electron emission device of claim 9, wherein the at least one lead portion and the at least one pad electrode is at the one-sided periphery of the second substrate as a pair, respectively.

11. The electron emission device of claim 9, wherein the anode electrode is a single electrode covering the phosphor layers.

12. The electron emission device of claim 1, wherein the electron emission structure includes electron emission regions for emitting electrons, cathode electrodes electrically connected to the electron emission regions, and gate electrodes electrically insulated from the cathode electrodes and the electron emission regions.

13. The electron emission device of claim 12, wherein the electron emission regions are a material selected from the group consisting of carbon nanotube, graphite, graphite nanofiber, diamond, diamond-like carbon, C60 and silicon nanowire.

14. A method of providing a hermetic seal between at least one anode electrode lead portion and an adhesive film of an electron emission device, the electron emission device including a first substrate and a second substrate facing each other, an electron emission structure on the first substrate, a light emission structure on the second substrate, the light emission structure including phosphor layers and an anode electrode on a surface of the phosphor layers, the method comprising:

connecting the at least one anode electrode lead portion to the anode electrode; and forming an adhesive film for attaching the first substrate and the second substrate to each other such that the at least one anode electrode lead portion crosses the adhesive film on the second substrate at a cross region;

wherein the at least one anode electrode lead portion is partitioned into a plurality of lead lines at the cross region.

15. The method of claim 14, wherein each of the at least one anode electrode lead portion is partitioned into the plurality of lead lines over the entire region of each of the at least one anode electron lead portion.

16. The method of claim 14, wherein the at least one anode electrode lead portion includes an opening portion at the cross region.

17. The method of claim 16, wherein the width of the opening portion is larger than the width of the adhesive film when measured along the length of the at least one anode electrode lead portion.

18. The method of claim 14, wherein at least one pad electrode is on the second substrate external to the adhesive film in a one to one correspondence with the at least one anode electrode lead portion.

19. The method of claim 18, wherein the at least one anode electrode lead portion and the at least one pad electrode are at the one-sided periphery of the second substrate as a pair, respectively.

20. The method of claim 18, wherein the anode electrode is a single electrode covering the phosphor layers.

* * * * *

UNITED STATES PATENT AND TRADEMARK OFFICE

CERTIFICATE OF CORRECTION

PATENT NO. : 7,518,303 B2
APPLICATION NO. : 11/291799
DATED : April 14, 2009
INVENTOR(S) : Byong-Gon Lee It is certified that error appears in the above-identified patent and that said Letters Patent is hereby corrected as shown below:

In the Claims

| | |
|---|---|
| Column 8, Claim 15, line 19 | Delete "electron",<br>Insert --electrode-- |

Signed and Sealed this

Sixteenth Day of February, 2010

David J. Kappos

David J. Kappos
*Director of the United States Patent and Trademark Office*